US007743507B2

(12) United States Patent
Nakano

(10) Patent No.: US 7,743,507 B2
(45) Date of Patent: Jun. 29, 2010

(54) ROTARY TYPE ELECTRIC SHAVER

(75) Inventor: Tsuyoshi Nakano, Matsumoto (JP)

(73) Assignee: Izumi Products Company, Nagano (JP)

( * ) Notice: Subject to any disclaimer, the term of this patent is extended or adjusted under 35 U.S.C. 154(b) by 138 days.

(21) Appl. No.: 11/353,669

(22) Filed: Feb. 14, 2006

(65) Prior Publication Data

US 2006/0179658 A1 Aug. 17, 2006

(30) Foreign Application Priority Data

Feb. 15, 2005 (JP) ..... 2005-038109

(51) Int. Cl.
*B26B 19/14* (2006.01)

(52) U.S. Cl. ..... 30/43.4; 30/43.5; 30/43.6

(58) Field of Classification Search ..... 30/43.6, 30/43.4, 43.5, 346.51
See application file for complete search history.

(56) References Cited

U.S. PATENT DOCUMENTS 2,632,948 A * 3/1953 Konrad ..... 30/43.6
3,526,959 A * 9/1970 Young ..... 30/43.6
5,544,414 A * 8/1996 Dekker et al. ..... 30/43.6
6,085,421 A * 7/2000 Jorna et al. ..... 30/43.6
2006/0156548 A1* 7/2006 Shimizu ..... 30/43.6

* cited by examiner

*Primary Examiner*—Boyer D Ashley
*Assistant Examiner*—Omar Flores-Sánchez
(74) *Attorney, Agent, or Firm*—William L. Androlia; H. Henry Koda

(57) ABSTRACT

A rotary type electric shaver with an outer cutter frame provided on a shaver main body. An outer cutter installed in this outer cutter frame and having its shaving surface on the upper surface of a ring-shaped thin layer portion. An inner cutter 16 having a cutter body that rotates and makes sliding contact from below with the lower surface of the outer cutter 14, wherein a thin layer portion 28 is formed in a substantially arc shape that is convex upward in a radial and vertical cross section that includes a center axis line which is the rotational center of the inner cutter. The thickness of the thin layer portion near the apex of the upward convex is smallest at the apex and gradually becomes thicker as distance increases away from the apex.

1 Claim, 5 Drawing Sheets

ROTARY TYPE ELECTRIC SHAVER

BACKGROUND OF THE INVENTION

1. Field of the Invention

The present invention relates to a rotary type electric shaver in which an outer cutter has a shaving surface on the upper surface of a ring-shaped thin layer portion thereof, and an inner cutter rotates while making sliding contact from below with the lower surface of the thin layer portion, thus cutting, with the inner cutter, whiskers or hair that enter into a hair introduction hole formed in the thin layer portion.

2. Description of the Related Art

In a type of electric shaver as described above, when the hair introduction hole (hereinafter "slit") that is a slit or the like formed in the thin layer portion of the outer cutter is firmly pressed against the skin during shaving, the skin enters from the slit and is cut too deeply by the rotating inner cutter and causes a burning feeling in the skin after the shaving. In order to prevent this sort of problem from occurring, it is obvious that the slit width can be made narrow or the outer cutter can be made thick. Here, making the outer cutter thick means increase in dimensions in the thickness direction of the ribs are located on both sides of the slit (the dimension in the direction parallel to the center axis line).

Japanese Patent Application Laid-Open (Kokai) No. H7-185148 teaches a solution to this problem, teaching that the upper surface (shaving surface) and lower surface of a ring-shaped thin layer portion formed in an outer cutter are shaped into convex upward in a vertical cross section that is a cross section in a radial plane that includes the center axis line, and the radial and vertical cross-sectional shape of the outer cutter is an arc shape that is substantially of constant thickness. This prior art improves the shaving feeling by appropriately setting the curvature of the thin layer portion of the outer cutter. More specifically, it sets the dimensions of a straight line connecting two points on the upper surface of the outer cutter corresponding to the inner and outer diameter of the inner cutter and the highest position on the upper surface of the outer cutter (apex) in a predetermined range.

When the thin layer portion of the outer cutter is curved convexly upward as disclosed in Japanese Patent Application Laid-Open (Kokai) No. H7-185148, the rigidity of the outer cutter increases, and it is possible to increase the pressing force of the outer cutter against the skin. Furthermore, the region near the center (or apex area) of the thin layer portion upper surface of the outer cutter (more specifically, the shaving surface) projects upward; as a result, when the shaver touches and presses the skin, it touches there firmly, and the pressing force becomes weak at positions distant from the center. Therefore, the problem is that if the slit width in the outer cutter is made constant, the skin near the center of the shaving surface enters the slit deeply, causing too deep shaving, and a burning feeling in the skin after shaving.

In order to prevent this sort of problem, if the slit width is constant, then the thin layer portion of the outer cutter can be made sufficiently thick as described above. However, if the thin layer portion is thick, at portions where the pressing force of the outer cutter against the skin becomes weak (or at portions distant from the apex of the thin layer portion), and it is not possible to shave deeply enough; and another problem occurs that the shaving feeling is unpleasant.

BRIEF SUMMARY OF THE INVENTION

The present invention is to overcome the problems described above.

It is, therefore, an object of the present invention to provide a rotary type electric shaver that obtains consistent and excellent shaving in a wide range of the outer cutter by a design that allows the pressing force of the outer cutter against the skin to be uniform.

The above object is accomplished by a unique structure of the present invention for a rotary type electric shaver that includes an outer cutter frame which is provided on a shaver main body, an outer cutter which is installed in the outer cutter frame and has a shaving surface on the upper surface of a ring-shaped thin layer portion thereof, and an inner cutter which is driven rotationally and has a cutter body which makes sliding contact from below with a lower surface of the thin layer portion of the outer cutter; and in the present invention:

the thin layer portion has a substantially arc shape that is convex upward in radial and vertical cross section that includes a center axis line which is the rotational center of the inner cutter, and the thickness of the thin layer portion is smallest near the apex of the above-describe convex arc shape and gradually becomes larger as the distance from the apex increases.

In the structure of shaver the present invention as described above, the thin layer portion of the outer cutter is formed in a substantially arc shape that is convex upward in a radial and vertical cross section, and the thickness at lest near the apex of such a upwardly convex shape is smallest (thinnest) at the apex and the thickness gradually becomes larger (thicker) with increasing distance from the apex increases or away from the apex. As a result, the amount of projection of the thin layer portion near the apex is reduced and concentration of pressing force near the apex is alleviated, and further the difference between pressing force near the apex of the shaving surface and pressing force at a position distant from the apex is small, and the pressing force of the outer cutter against the skin is made uniform. Accordingly, it is possible for the shaver of the present invention to provide a consistent shaving feeling in a wide range of the shaving surface of the outer cutter.

Furthermore, when the shaving surface of the outer cutter is slid over the skin during shaving, the skin firmly touches the outer circumference of the outer cutter; however, since the outer cutter is thick in the outer circumference portion, whiskers or hair can be introduced into the slit without being shaved too deeply. When the outer cutter (or the shaver) is moved in this state, the hair that entered the slit is guided to the thin portion of the thin layer portion, and here it is shaved or cut with sufficient depth. Thus, appropriately deep shaving is achieved and excellent shaving feeling can be obtained.

The outer cutter used in the present invention has a single ring-shaped thin layer portion; and this is because in a radial and vertical cross section of the outer cutter, the range in which the thin layer portion is substantially arc shaped is wide, so the range in which the thickness near the center (near the apex) is thin is large, and the effect and function of the present invention is accomplished sufficiently. However, the present invention can be used for a shaver that has an outer cutter which has two concentric thin layer portions (double track) and a shaver that includes an outer cutter which has three or more concentric thin layer portions.

In the present invention, the curvature radius center (center of curvature) for the apex area of the shaving surface can be set farther from the shaving surface than the center of curvature of the lower surface of the thin layer portion, with both of these center of curvatures being located on a straight line that passes through the apex of the shaving surface parallel to the center axis line.

Instead of the upper surface (shaving surface) of the thin layer portion following a single curvature radius in a radial and vertical cross section, it is in the present invention possible to design such that the upper surface has a shape wherein a predetermined range in the radial direction and inclusive of the highest position (the apex) is removed (by for instance cutting out) along a plane that is substantially orthogonal to the center axis line which is the rotational center of the inner cutter; in other words, the shaving surface can be formed with a ring-shaped flat surface portion that is substantially orthogonal to the center axis line which is the rotational center of the inner cutter. The curvature radius of the flat plane (obtained by cutting out in this case) is infinitely large; accordingly, it is obviously larger than the curvature radius of the lower surface.

In the above structure, the plane along which cutting out is made for the upper surface of the thin layer portion is a plane substantially orthogonal to the center axis line of the outer cutter; accordingly, the predetermined width portion which is flat is substantially concentric to the outer cutter and substantially ring-shaped. However, in the present invention, this plane can be not orthogonal to the center axis line; in this case, the predetermined width portion of the flat surface is substantially arc shaped in plan view or a circle having the width varying in the circumferential direction. In this structure, since the radial direction range where the thin layer portion is thin varies in the circumferential direction, the shaving feeling can vary by changing the angle of the circumferential direction of the outer cutter.

For example, if a shaver has a plurality of outer cutters and inner cutters, the pressing force tends to be larger on a part of each outer cutter that faces the outer peripheral side of the outer cutter frame and deep shaving is likely to occur there; accordingly, in the present invention, the range of flat portion on the upper surface of the thin layer portion of the outer cutter can be made narrow on the outer peripheral side of the outer cutter frame, and a predetermined circumferential range of the outer cutter on the center side of the outer cutter frame can be made substantially arc shaped or be in a sector shape when viewed from above.

In the present invention, the cut-out range (or the flat area) of the upper surface of the thin layer portion of the outer cutter can be smaller than a contact width which the inner cutter makes contact with the lower surface of the thin layer portion. With this structure, both lateral ends of the contacting edges of the inner cutter are located outside the cut-out or flat range. As a result, since both lateral ends of the contacting edges of the inner cutter are located outside the cut-out or flat range and within a thick portion of the thin layer portion, skin will not touch both ends of the contact edges of the inner cutter, which are sharply pointed, and the skin is prevented from being at risk of damages.

DETAILED DESCRIPTION OF THE INVENTION

Figure 1:
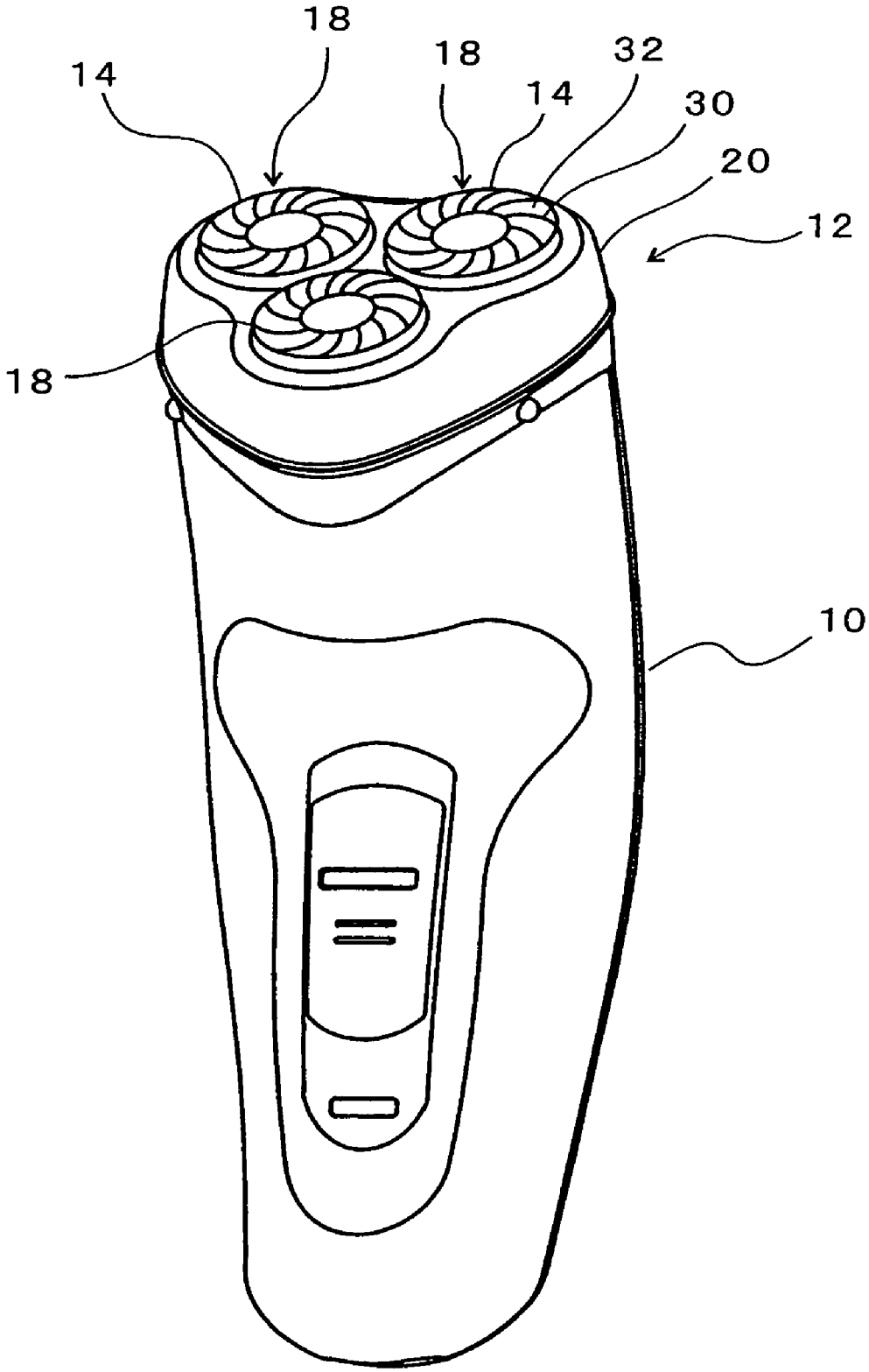
FIG. 1 is a perspective exterior view of the electric shaver according to one embodiment of the present invention.

In FIG. 1, the reference numeral 10 is a shaver main body, and 12 is a cutter head openably or detachably attached to the upper portion of the shaver main body 10. Three cutter units 18 each consisting of an outer cutter 14 and an inner cutter 16 and so forth are installed in the cutter head 12. Three outer cutters 14 of the three cutter units 18 are positioned with their centers at vertices of an equilateral triangle.

The cutter head 12 has an outer cutter frame 20 that is openable or detachable upward relative to the shaver main body 10. The outer cutters 14 are installed in three other cutter installation holes formed in the outer cutter frame 20. The cutter unit 18 that includes the outer cutter 14 is urged upward or in the direction such that the outer cutter 14 projects outward.

Figure 2:
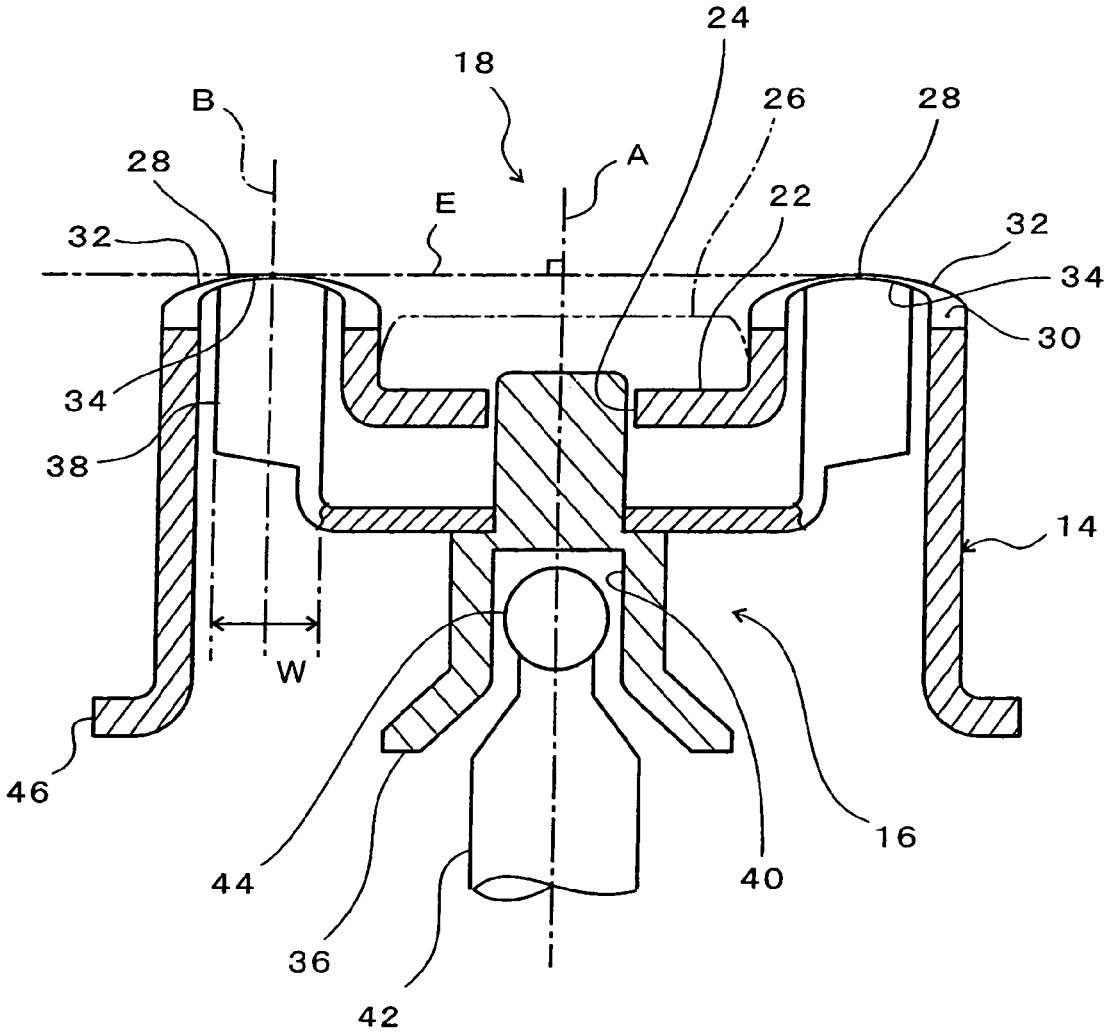
FIG. 2 is a cross-sectional side view of a cutter unit used in the shaver of FIG. 1.

The outer cutter 14 is made of metal in which a metal plate is formed into a substantially disk shape (see FIG. 2). A recess 22 that is circular in plan view is formed in the center of the upper surface of the outer cutter 14, and a circular aperture 24 is formed in the center of the recess 22. The central tip of the inner cutter 16, which will be described later, is inserted into this aperture 24 of the outer cutter 14, preventing axial vibration of the inner cutter 16. A cap 26 is fixed in the recess 22 of the outer cutter 14 from above.

A ring-shaped thin layer portion 28 that bulges upward and that is concentric (when seen from above) with the center axis line A is formed in the upper surface of the outer cutter 14 so that the ring-shaped thin layer portion 28 surrounds the recess 22 and the cap 26. The upper surface of the thin layer portion 28 make the shaving surface, and its lower surface is an inner cutter running groove 34 (described below). In reality, the thin layer portion 28 is extremely thin, but it is shown thick in the drawing for ease of understanding.

As seen from FIG. 1, a plurality of slits 30, which transect the thin layer portion 28 from the center axis line A in substantially the radial direction, are formed in the outer cutter 14. More specifically, the slits 30 are formed along straight lines at a constant angular inclination relative to the radial straight line passing through the center axis line A in FIG. 2 Though the slits 30 are thus straight, they can be curved as shown in FIG. 1. The lower surface of a rib 32, which remains between adjacent slits 30, works together with the inner cutter 16 and forms a cutter that cuts the hair.

The radial and vertical cross section described below is, to be precise, a vertical cross section in a direction of the slit 30, but it may also be those that include a vertical cross section along the slit 30; no particular distinction is made here.

The upper and lower surfaces of the rib 32 of the outer cutter 14, in a radial and vertical cross-sectional view (FIG. 3) centered on the center axis line A, are formed in an arc-shaped curved surface centered on a curvature radius center (center of curvature) C, which is located on a perpendicular line B parallel to the center axis line A and passing through the center of the thin layer portion 28, i.e. the apex. More specifically, if $R_1$ is the curvature radius of the lower surface of the rib 32, the curvature radius $R_2$ of the upper surface of the rib 32 is set so that $R_2=R_1+a$, where a is the thickness of the rib 32.

Figure 3:
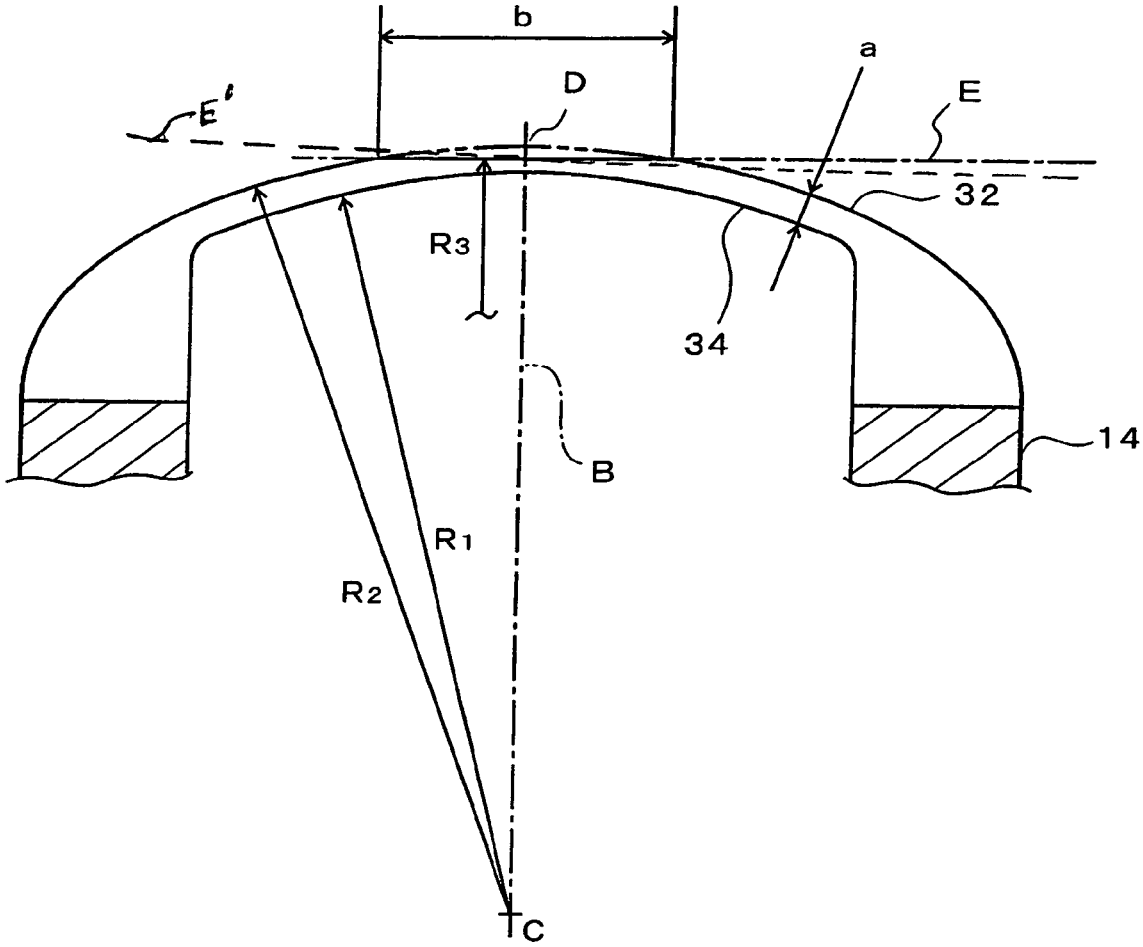
FIG. 3 is an enlarged cross-sectional view of a part of an outer cutter used in the shaver of FIG. 1.

Furthermore, a predetermined (lateral or horizontal) range of a width b of the upper surface of the rib 32 that includes the apex D is formed flat by removing (cutting out) a top portion of the rib 32 according to a plane E that is orthogonal to the center axis line A (FIG. 2). The upper surface is thus flat at this predetermined range b, and as a result the curvature radius $R_3$ is infinitely large. Also, it is possible to provide the plane E such that it is not orthogonal to the center axis line A as is also shown in FIG. 3 as a dashed line.

The lower surface of the thin layer portion 28 of the outer cutter 14 (in other words, the lower surface of the rib 32) is the inner cutter running groove (ring-shaped track) 34. Seen from below, the inner surface (bottom surface) of the inner cutter running groove 34 takes a curved surface with curvature radius $R_1$.

The inner cutter 16 is comprised of a resin-made boss element 36 that opens downward and a plurality of cutter bodies 38 surrounding the boss element 36 and equidistantly fixed circumferentially. The plurality of cutter bodies 38 can be formed so as to be connected to form a ring shape. The upper portion of the cutter body 38 makes sliding contact from below with the inner cutter running groove (track) 34 of the outer cutter 14. Furthermore, the upper edges of the cutter bodies 38 form cutting blades that are grinded to a curved surface with curvature radius $R_1$, the same curvature as the lower surface of the rib 32. Furthermore, as seen from FIG. 2, the width W in the radial direction of the cutter body 38 is positioned within the thin layer portion 28 of the outer cutter 14. In other words, the width b of the flat surface portion of the outer cutter can formed smaller than the width W of the cutter body 38 of the inner cutter, thus being b<W.

An engagement hole 40 that opens downward and that has a quadrilateral shape when seen in plan view is formed in the boss element 36, and a drive shaft 42 that projects from the shaver main body 10 engages the engagement hole 40. A quadrilateral spherical engagement head 44 is formed at the upper end of the drive shaft 42 so as to enter the engagement hole 40 of the boss element 36 from below. The drive shaft 42 is rotationally driven by a motor (not shown in the drawing) housed inside the shaver main body 10 and rotates the inner cutter 16.

The drive shaft 42 has a property of reciprocating along the center axis line A and urged in the upward projecting direction, and presses the inner cutter 16 upward or against the outer cutter 14. Therefore, the cutter bodies 38 of the inner cutter 16 elastically press the inner cutter running groove 34 of the outer cutter 14 from below.

Furthermore, a flange 46 is formed along the lower periphery of the outer cutter 14 so as to projects radially outward. The flange 46 of the outer cutter 14 engages inside the outer cutter installation hole (not shown in the drawing) formed in the outer cutter frame 20 from below. Accordingly, the cutter unit 18 that is comprised of the outer cutter 14 and the inner cutter 16 can sink downward relative to the outer cutter frame 20 with elasticity.

According to the structure described above, the upper surface of the outer cutter 14 opposite the inner cutter running groove (track) 34—more specifically, the upper surface of the rib 32—has such a shape that a predetermined range b that includes the apex is obtained by cutting out at plane E that is orthogonal to the center axis line A, so that the height of the upper surface changes smoothly. Therefore, the thin layer portion 28 is thinnest at the apex D and gradually becomes thicker as distance from the apex D increases away from the apex D. Accordingly, when the skin presses and touches perpendicular to the shaving surface of the outer cutter 14, it touches the shaving surface of the outer cutter 14 uniformly, and the pressing force can be averaged; and as a result, it is possible to shave the hair consistently and smoothly across a wide area.

Furthermore, since it is thinnest near the apex D and gradually becomes thicker as the distance increases away from the apex D in the radial direction from the apex D, when the skin is perpendicular to the outer cutter 14 and presses and touches the outer cutter 14, it is possible to shave hair deeply with appropriate depth near the center.

When the outer cutter 14 (or the shaver) is moved parallel to the skin, the skin firmly touches the outer peripheral portion or the inner peripheral portion of the outer cutter 14. In this case, since the outer cutter 14 is thick near the outer and inner periphery portions, overly deep shaving is prevented.

When the skin firmly presses the peripheral portions of the outer cutter 14, hair easily enters the slits 30; and by moving the outer cutter 14 (or the shaver) with the hair entered in the slits 30, hair is guided by the slit 30 and moves radially near the center and shaved with appropriate depth at the thin predetermined range b.

Furthermore, as seen from FIG. 2, the cutter body 38 of the inner cutter 16 (the cutter body 38 having the width W) is located within the thin layer portion 28 of the outer cutter 14 (b<W), both side ends of the cutter body 38 are within the thick region of the outer cutter, and there is no risk that both ends of the cutter body 38 damage the skin.

In the above-described structure, the upper surface of the outer cutter 14 opposite the inner cutter running groove (track) 34 (more specifically, the upper surface of the rib 32)—is formed flat for the predetermined range b that includes the apex and the plane E that is orthogonal to the center axis line A. However, the flat portion can be formed flat on a plane that is not orthogonal (or not at right angles) to the center axis line A. In this slanted flat portion structure, the predetermined width b portion becomes substantially a ring shape in plan view whose width varies in the circumferential direction; and since the radial direction range where the thin layer portion is thin varies in the circumferential direction, the shaving feeling can vary by changing the angle of the circumferential direction of the outer cutter.

Figure 4:
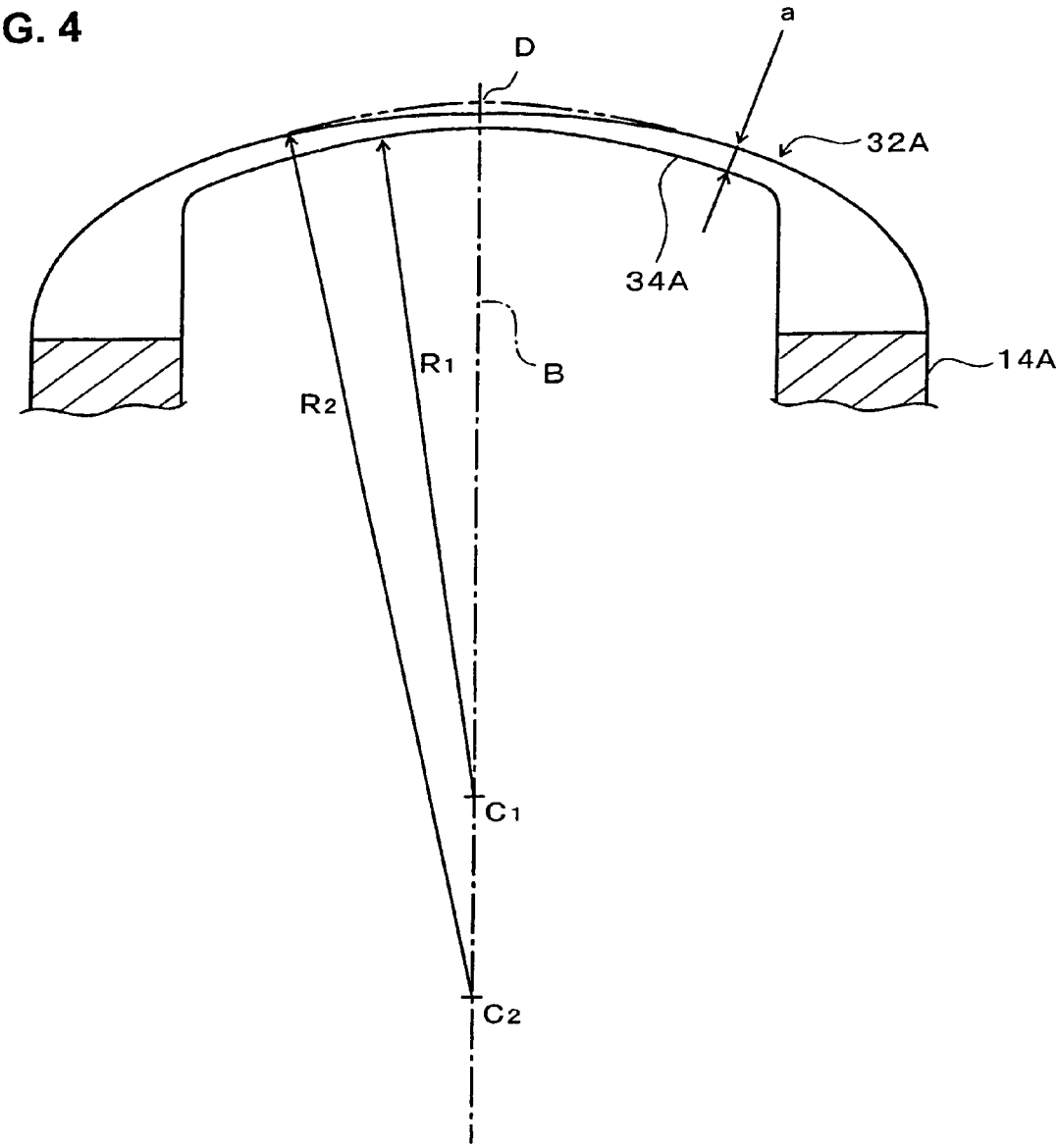
FIG. 4 is an enlarged cross-sectional view of a part of an outer cutter used in another embodiment of the present invention.

FIG. 4 shows another embodiment of the present invention.

In the outer cutter 14 shown in FIG. 4, the curvature radius $R_2$ of the upper surface of the rib 32A of the outer cutter 14A is made sufficiently large with respect to the curvature radius $R_1$ of the lower surface, and the center of curvature $C_2$ of the upper surface is farther away from the outer cutter 14A on a straight line B than the center of curvature $C_1$ of the lower surface. In other words, $R_2>R_1+a$, where a is the thickness of the rib 32A.

In the structure of FIG. 4, the rib 32A is thinnest near apex D of the imaginary curved surface (see the double-dot broken line) centered on $C_1$, and its thickness increases continuously with the increase in the radial distance from here. Accordingly, the same effect as in the structure shown in FIG. 3 is achieved. In particular, in the structure of FIG. 4, the curvature of the upper surface of the rib 32A is constant and smooth, thus achieving the effect that the shaving feeling is even smoother than that of the structure of FIG. 3.

Figure 5:
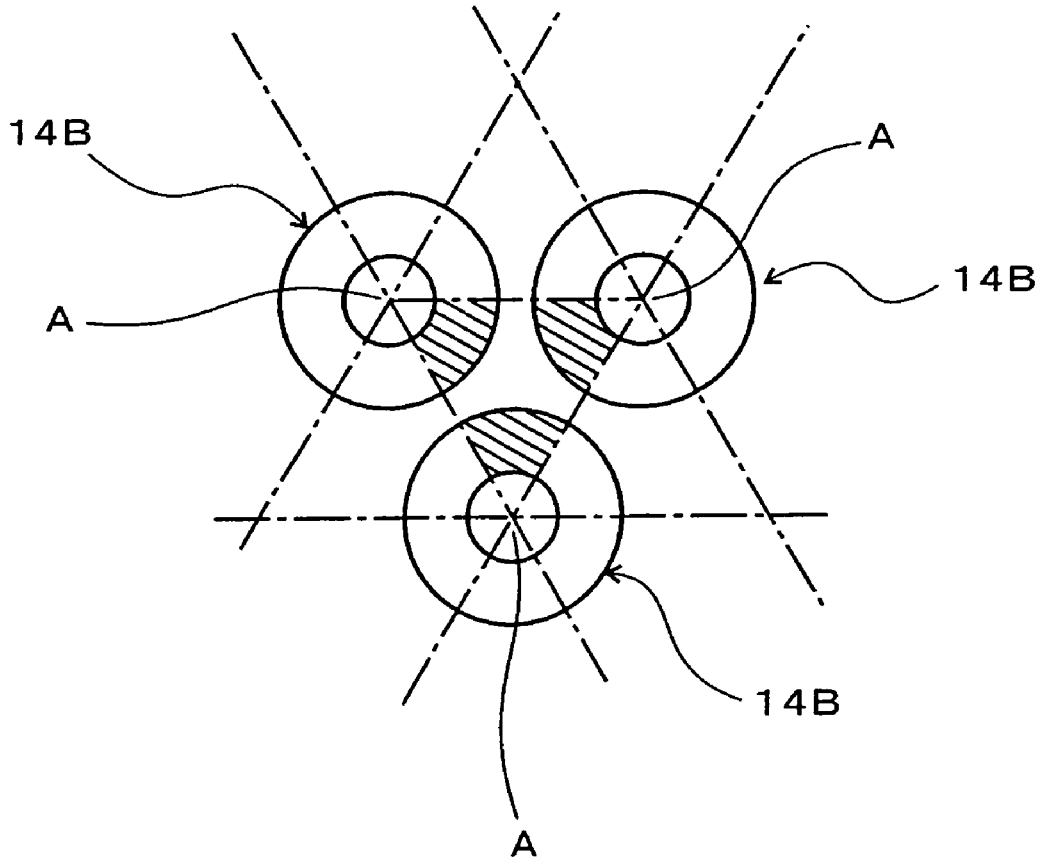
FIG. 5 shows the arrangement of outer cutters employed in the present invention.

FIG. 5 shows the arrangement of the outer cutters 14B in accordance with the present invention.

The outer cutters 14B are arranged with their centers A in an equilateral triangle in plan view. Furthermore, in each outer cutter 14B the portion inside the triangle AAA (the shaded portion) has the structure described above in FIG. 3 or FIG. 4, and the portion outside the triangle AAA has a structure in which the thickness of the thin layer portion is constant. More specifically, the shaded portion of an arc or sector shape of each one of the outer cutters is thin in the predetermined range near the apex, and the area outside the shaded portion of each outer cutter has a thickness that is substantially the same as that of the inner and outer peripheral areas of the shaded portion and that is sufficiently thick and constant.

With the arrangement shown in FIG. 5, even if the skin wrinkles at a part of each outer cutter that face the outer peripheral side of the outer cutter frame because of the outer edge of the outer cutter 14B when the outer cutter 14B (or the shaver) is moved, the skin has difficulty reaching the cutter body 38 and there is no risk that the skin is damaged, because the outer cutter 14B has a constant, large thickness on the outer peripheral side of the outer cutter frame. Furthermore, if the skin is pressed near the center of the triangle AAA, since the outer cutter 14B in this region is thin near the apex, it is possible to shave smoothly and with sufficient depth with a light pressing force. It is thus possible in the present invention to combine the inconsistent thickness structure of FIG. 3 or 4 and the constant thickness structure in view of the wrinkle occurrence status and the like.

The invention claimed is:

1. A rotary type electric shaver comprising an outer cutter frame tat is provided on a shaver main body, an outer cutter that is installed in said outer cutter frame and has a shaving surface on an upper surface of a ring-shaped thin layer portion thereof, and an inner cutter that is driven rotationally and has a cutter body which makes sliding contact from below with a lower surface of said thin layer portion of said outer cutter, wherein said thin layer portion has a substantially arc shape that is convex upward in said radial and vertical cross-section that includes a center axis line which is a rotational center of said inner cutter, a thickness of said thin layer portion is smallest near an apex of said convex arc shape and becomes larger as a distance from said apex increases, and said shaving surface of said outer cutter is formed therein with a flat surface portion that is not orthogonal to said center axis line.

* * * * *